United States Patent [19]

Rasmussen

[11] 4,366,597

[45] Jan. 4, 1983

[54] MULTI-PINTLE HINGE

[76] Inventor: Villum B. K. Rasmussen, No. 6 Sølystparken, 2930 Klampenborg, Denmark

[21] Appl. No.: 159,462

[22] Filed: Jun. 16, 1980

[30] Foreign Application Priority Data

Jul. 10, 1979 [DK] Denmark ..... 2904/79

[51] Int. Cl.[3] ..... E05D 1/04

[52] U.S. Cl. ..... 16/368; 16/364

[58] Field of Search ..... 16/163, 166, 179, 368, 16/364

[56] References Cited

U.S. PATENT DOCUMENTS 2,100,928 11/1937 Way ..... 16/166
3,028,621 4/1962 Anderberg et al. ..... 16/163 X
4,226,002 10/1980 Davis ..... 16/179

FOREIGN PATENT DOCUMENTS 1028251 5/1966 United Kingdom .

*Primary Examiner*—Werner H. Schroeder

*Assistant Examiner*—Andrew M. Falik

*Attorney, Agent, or Firm*—Lane, Aitken, Kice & Kananen

[57] ABSTRACT

In a hinge device for tiltable windows, the base plate of the sash portion is provided with a pivot pin journalled in a guide member which is connected to the base plate of the frame portion in such a manner as to be mainly translatorily displaceable in relation thereto, whereby the pin during the initial opening movement of the window is moved downwards and outwards in relation to the frame portion. The sash portion of the hinge is also provided with a guide pin which by co-operation with guiding members on the frame portion co-ordinates the tilting movement of the sash portion about the pivot pin with the movement of displacement of the pin with a view to obtain a sash movement allowing outer covering elements to be arranged with an efficient overlapping relationship in the hinge area. By maximum displacement of the pivot pin the guide pin clears the guiding members so that the sash is free to tilt further in the opening direction while a stop prevents a rearward displacement of the guide member.

2 Claims, 3 Drawing Figures

MULTI-PINTLE HINGE

BACKGROUND OF THE INVENTION

Windows of the tiltable type, in particular of the kind adapted to be installed in sloping roofs, must satisfy heavy demands with respect to weathertightness and in general they therefore comprise an inner rabbet or abutment fillet aiming particularly at eliminating draft, and an external metallic or plastic covering primarily intended to prevent rainwater from penetrating between the stationary frame and the sash of the window. The rabbet fillet as well as the outer covering are necessarily divided at the pivot axis, i.e. in the areas of the hinge devices, the portions of the fillet and covering above the axis being secured to the frame, while the portions below the axis are mounted on the sash so as to follow the movements thereof. A condition of an optimum tightness is that the rabbet fillet forms a tight closure below the hinges, thereby restricting the permissible depth of the hinges, i.e. their dimension perpendicular to the plane of the window, but it is even more important that the hinges guide the sash so as to allow a sufficient overlapping, in the closed position of the window, between the movable and non-movable parts of the outer covering without causing these parts to prevent a tilting of the window sash through approximately 180°, or without causing the parts to be damaged by such a movement of the sash.

The sash should moreover be balanced in such a manner that, at least within certain open positions, it remains immovable in any angular position in relation to the stationary frame, and it should further be easily mounted in and dismounted from the frame, for instance with respect to changing its pane.

These requirements are considered to be fulfilled by a hinged device of the kind illustrated in FIGS. 6 and 7 of British patent specification No. 1,028,251 which discloses a tilting window hinge device comprising frame and sash portions having a curved guide and a correspondingly shaped sliding rail, respectively, which together define a tilting axis located at a slight distance outside the outer surface of the window. The sliding rail member of the sash portion is connected to the base plate of the same portion through a pivot pin allowing a further tilting of the sash after the termination of the displacement of the sliding rail member along the curved guide of the hinge portion of the frame.

In a hinge structure of this design it is difficult to control the frictional properties of the sliding rail and guide members and, consequently, to control the balancing conditions of the window sash without preventing a conveniently easy opening and closing movement of the sash. A further fact is that the prior art hinge in practice must include a large number of components which may well be produced relatively cheaply, but still they require rather expensive stamping tools and many assembling operations.

SUMMARY OF THE INVENTION

The invention relates to a hinge device which is of the same general type as the one referred to above but which solves the problems caused by the varying friction to which the displaceable sliding rail of the known hinge is subjected. A particular feature of the hinge device of the present invention resides in a bearing member which, through a pivot pin, is connected to the base plate of one of the hinge portions and is displaceable in a substantially translatory way relative to the base plate of the other hinge portion.

In this case the bearing member may be a simple blank stamped out from a metal sheet, and also its connection to the base plate of the hinge portion concerned may be obtained in a structurally simple manner, e.g. by means of a pair of links or straps, as more fully explained in the following. It is hereby made possible, within the confined space available for the hinge, to choose the movement of the guide member according to desire. This implies that, contrary to what is the case of the above mentioned prior construction, the pivot pin need not necessarily follow a circular arc between its two extreme positions. As a result, a substantial independence is obtained as to determining the movement of the window frame in the vicinity of its closed position, whereby the tightness between the stationary and movable parts of the outer covering may be improved inasmuch as their area of overlapping may be enlarged and/or their spacing in this area may be reduced. Moreover, in its outer extreme position, the pivot pin may be displaced as far away from the plane of the window as to allow a tilting of the sash through approximately 180° without causing the covering parts to get jammed.

BRIEF DESCRIPTION OF THE DRAWINGS

The above and other details of the hinge device according to the invention will be more fully explained in the following detailed description with reference to the drawing, in which.

DETAILED DESCRIPTION

Figure 1:
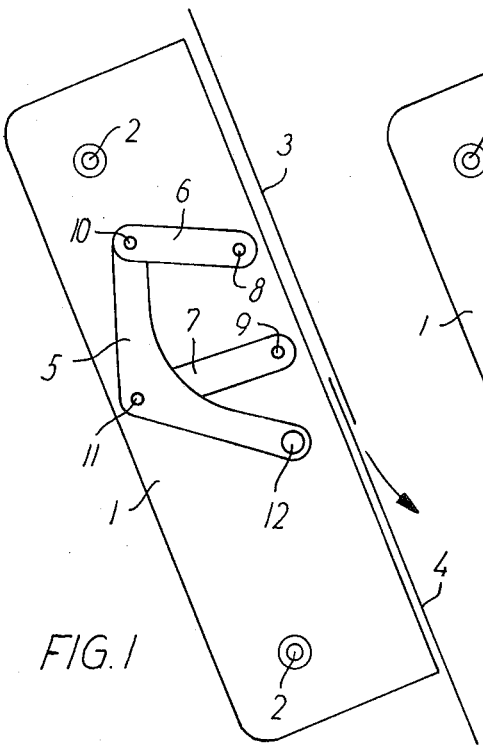
FIG. 1 is a schematical view of the hinge according to the present invention, in connection with a relatively steep overhead window shown in its closed position, the outer covering being shown purely diagrammatically.

FIG. 1 shows only the frame portion of the hinge device which comprises a base plate 1 provided with screw holes 2. This hinge portion is supposed to be mounted in a stationary frame, not shown, so that its front edge is substantially flush with the outer surface of the frame to which a plate covering 3 is secured, which extends from the top downwards to the hinge area where it overlaps a corresponding covering 4 on the movable sash, not shown. By the initial opening movement of the sash the top end of the sash covering 4 will substantially follow the arrow so as to get clear of the frame covering 3. This movement may be regarded as a displacement downwards and outwards in relation to the frame, combined with a controlled pivoting or tilting of the sash, although FIGS. 1 and 2 only show the mechanism serving to guide the displacement. In the shown embodiment, the said mechanism incorporates only three elements, viz. a bearing member 5 in the form of an angular blank stamped out from sheet metal, and two more or less parallel links or straps 6 and 7, which at one end are connected with the base plate 1 adjacent its front edge through hinge pins 8 and 9 and at their other end are rotatably connected through pins 10 and 11 with the bearing member 5 at its upper end and in the vicinity of its center, respectively. At its lower end the member 5 has a hole 12 serving as a bearing for the pivot pin 13, FIG. 2, of the sash. This pivot pin 13 is secured to a base plate 14 that may have the same contour as the base plate 1 of the frame portion. The lengths of the links 6 and 7 and the locations of their pivot points 8 to 11 may be chosen so that, within certain limits, the path of the mainly translatory displacement of the bearing member 5 between the positions in FIGS. 1 and 2 can be determined as desired. One or each of the links 6 and 7 could be substituted by a guide pin and an associated guiding track to determine the movement of the member 5, but in this case it might be more difficult to control the frictional properties of the hinge.

Figure 2:
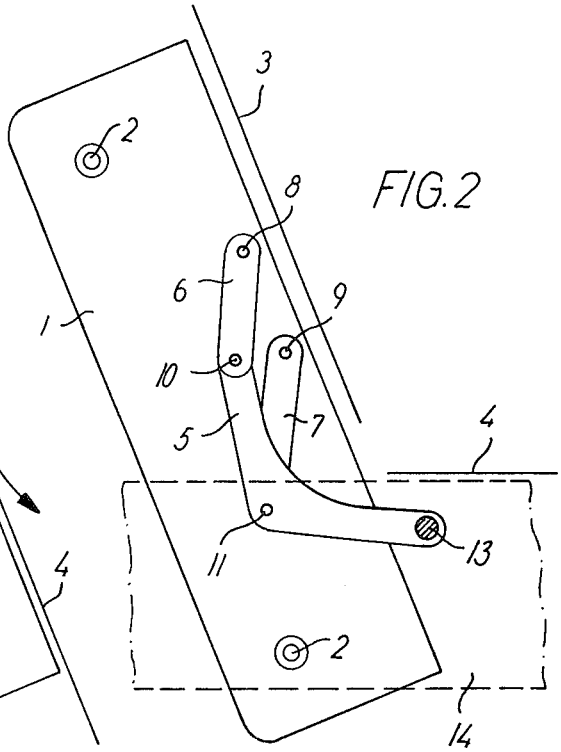
FIG. 2 shows the same hinge subsequent to the maximum displacement of its bearing member carrying the pivot pin.
Figure 3:
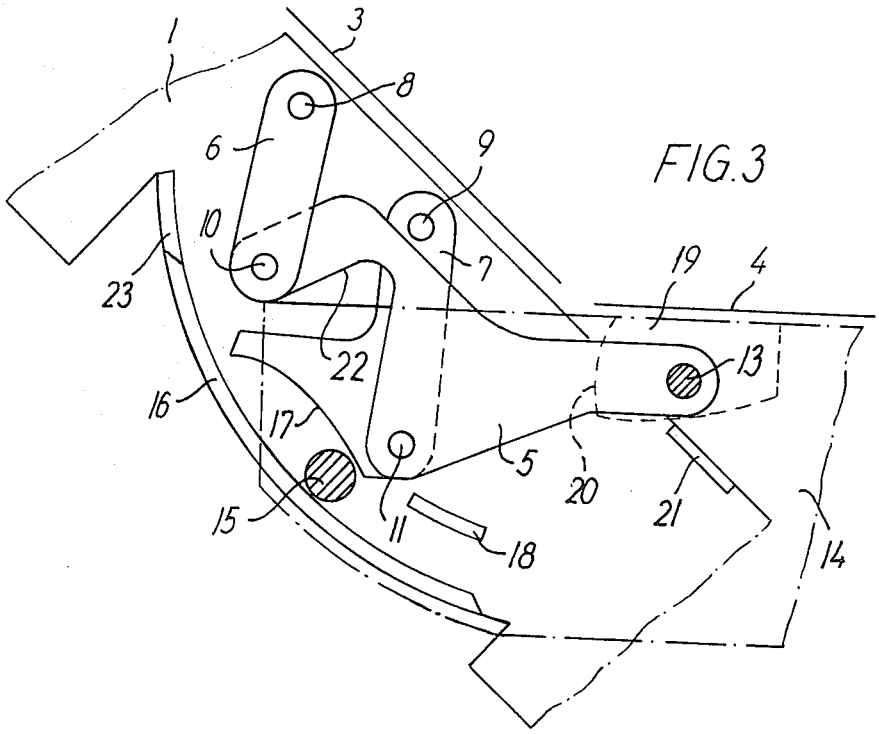
FIG. 3 is an illustration of an alternate embodiment of a complete hinge device according to the present invention intended for a tilting window having a smaller inclination than assumed in FIGS. 1 and 2.

FIG. 3 shows a fragmentary view of a complete hinge according to an alternate embodiment of the invention, the frame portion being shown in full lines while the sash portion is shown in dot-and-dash lines in an intermediate position. The same reference numerals as in FIGS. 1 and 2 are used for analoguous parts. As it will be seen, not only the pivot pin 13 journalled in the bearing member 5 is fixedly secured to the base plate 14 of the sash portion, but also a guide pin 15 serving to co-ordinate the rotation or tilting of the sash about the pivot pin 13 with the displacement of the bearing member 5. This is ensured by the fact that the guide pin 15 slides along the concave side of an arc-shaped guiding rail 16 on the base plate 1 of the first hinge portion, thereby limiting the possibility of the second hinge portion of rotating counterclockwise about the pivot pin 13. An oppositely directed rotation is also limited, viz. by the link 7 which presents an edge 17 facing toward the guiding rail 16 and cooperating with the guide pin 15 so as to keep this pin against the guiding rail, at any rate during the major part of the displacement of the bearing member 5. When the member approaches the outer position corresponding to FIG. 2, the pin 15 leaves the edge 17, the guide function of which is then undertaken by a short inner guide cam 18 on the base plate 1.

When the bearing member 5 arrives at the said outer position, the pin 15 has left the lower end of the guiding rail 16 so that the sash is now free to continue its movement in the direction of opening by revolving on the pivot pin 13. During this further movement a rearward displacement of the bearing member 5 is prevented. This is ensured by means of a cam disc 19 which is secured to the underside of the base plate 14 and presents an arc-shaped front edge 20 that in this situation slides along a stop or abutment 21 on the base plate 1 of the frame portion of the hinge.

A V-shaped recess 22 in the bearing member 5 serves to provide space for the guide pin 15 during the final part of its movement when the window is being closed. If the guiding rail 16 during this final movement is obstructive to the members 5, 6 and 7, it may be provided with necessary recesses to allow their unobstructed movement. Such a recess 23 for the link 6 is shown at the upper end of the guiding rail 16.

I claim:

1. A hinge device for tilting type windows, in particular for inclined overhead windows, comprising:

a first hinge portion including a first base plate to be mounted on a stationary frame of the window, a second hinge portion including a second base plate to be mounted on a tiltable sash of the window, a pivot pin firmly secured to said second base plate, a bearing member in which said pivot pin is journalled, substantially parallel link means movably interconnecting said first base plate and said bearing member so as to allow a substantially translatory displacement of said bearing member between first and second positions in which said pivot pin is located inside a front edge of said first base plate and outside said front edge, respectively, a curved guide member on said first base plate having its concave side facing said bearing member, and a guide pin on said second base plate displaceable along the concave side of said guide member to coordinate the displacement of said bearing member with the tilting of said second base plate on said pivot pin, said substantially parallel link means being journalled at their ends to the bearing member and the first base plate, respectively, and one of the link means having an edge opposed to the concave side of said guide member to limit the possible movement of said guide pin away from said concave side.

2. A hinge device as claimed in claim 1 wherein said parallel links are at one end pivotally connected with said first base plate adjacent to an outer edge thereof and at their other end are pivotally connected with the bearing member at an end portion opposite to the pivot pin and at an intermediate point, respectively.

* * * * *